US005427342A

United States Patent [19]

Gagnon

[11] Patent Number: 5,427,342

[45] Date of Patent: Jun. 27, 1995

[54] SUPPORT FOR LAWN FURNITURE LEG

[76] Inventor: Donald F. Gagnon, 11 Hook Rd., Candia, N.H. 03034

[21] Appl. No.: 201,977

[22] Filed: Feb. 25, 1994

[51] Int. Cl.[6] ..... F16M 13/00; A47B 91/00

[52] U.S. Cl. ..... 248/188.9; 182/108; 248/346.1; 248/357

[58] Field of Search ..... 248/188.9, 36.1, 345.1, 248/347, 910, 357, 188.8; 182/108

[56] References Cited

U.S. PATENT DOCUMENTS

| | | | |
|---|---|---|---|
| 2,736,130 | 2/1956 | Boiu | 248/188.9 |
| 2,875,552 | 3/1959 | Stillman | 248/188.9 |
| 3,625,462 | 12/1971 | Jordan | 248/188.8 |
| 3,883,923 | 5/1975 | England | 248/188.9 X |
| 4,200,254 | 4/1980 | Nelson | 248/188.8 |
| 4,658,521 | 4/1987 | Thorpe | 248/188.9 X |
| 4,915,335 | 4/1990 | Miles | 248/188.8 |
| 5,141,076 | 8/1992 | Joyce et al. | 248/188.9 X |

FOREIGN PATENT DOCUMENTS

| | | | |
|---|---|---|---|
| 928600 | 5/1955 | Germany | 248/188.8 |
| 87219 | 2/1956 | Norway | 248/188.8 |
| 302481 | 10/1954 | Switzerland | 248/188.9 |
| 888583 | 1/1962 | United Kingdom | 248/188.9 |

*Primary Examiner*—Karen J. Chotkowski

*Attorney, Agent, or Firm*—Hayes, Soloway, Hennessey, Grossman & Hage

[57] ABSTRACT

A support is provided for positioning on the base of a wooden lawn furniture leg. The support has an area that is at least five times the area of the bottom of the leg to distribute the load over a large area. This permits easy sliding of the leg across a lawn. The support is arranged to prevent prolonged contact of the leg with a source of moisture. In addition, the support provides venting to the bottom of the leg to minimize dry-rot.

7 Claims, 1 Drawing Sheet

SUPPORT FOR LAWN FURNITURE LEG

The present invention is directed to a support for heavy lawn furniture particularly wooden lawn furniture such as cedar redwood chaises, picnic tables and the like.

BACKGROUND OF THE INVENTION

Heavy wooden lawn furniture has become increasingly popular, particularly cedar redwood and the like which can be left outdoors in all types of weather. While such furniture is esthetically attractive it is difficult to move such as when mowing the lawn or when replacing the furniture for reasons of shade, sun or the like. In trying to move such heavy furniture it often requires two people or awkward lifting one end and then the other. It normally cannot be slid across the lawn since the heavy (normally rectangular) legs will dig into the lawn damaging both the lawn and the furniture.

BRIEF SUMMARY OF THE INVENTION

It is a principal object of the present invention to provide a support for such lawn furniture which will provide an extended surfaces at the bottom of each leg which will provide a lower unit pressure on the lawn and will engage the lawn in such a way that the furniture can be easily slid across the lawn without damaging the lawn. The invention, in a preferred form, comprises a unitary molded element having an area for engaging the surface of the lawn which has an area preferably at least five times greater than the area of the bottom of the leg. This unitary structure preferably has means for supporting the bottom of the leg so that most of the bottom of the leg is spaced from the support to permit easy drying of the bottom of the leg and to prevent dryrot. Means are also provided for engaging the sides of the leg to secure the support to the furniture leg.

DETAILED DESCRIPTION OF THE INVENTION

Figure 1:
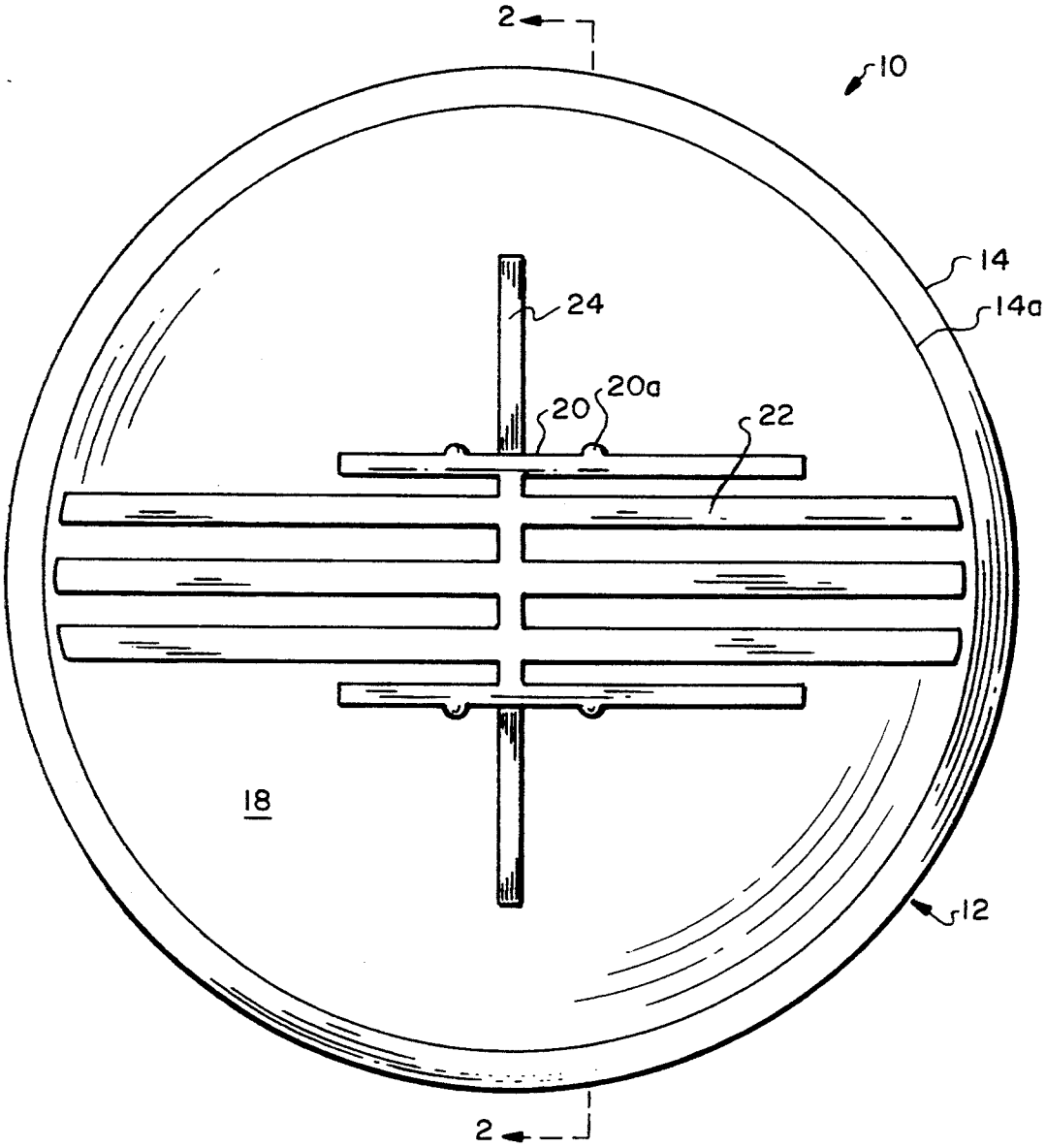
FIG. 1 is a diagramatic schematic top view of one preferred form of support.
Figure 2:
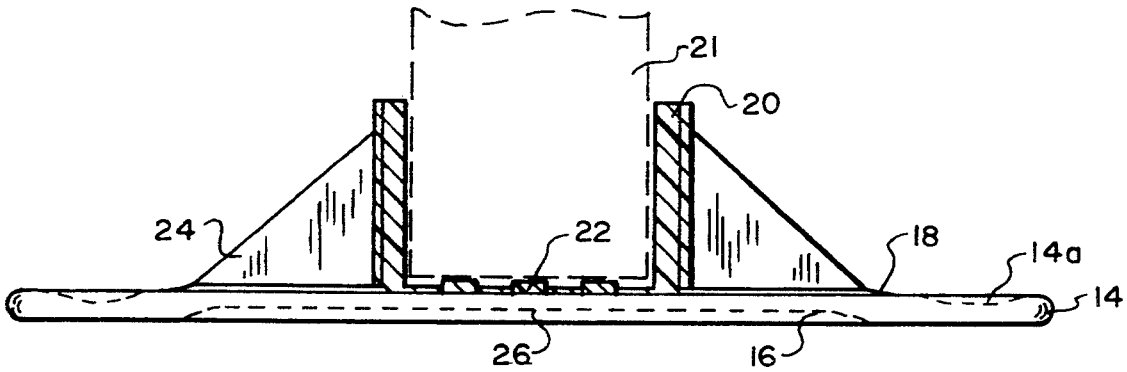
FIG. 2 is a diagramatic schematic sectional view along the line 2—2 of FIG. 1 showing various features of the support.

Referring to FIGS. 1 and 2, the support which is generally shown as 10 comprises a unitary molded structure 12 having a circular edge 14. As seen best in FIG. 2, the support 12 has a bottom surface 16 and an upper surface 18. A pair of upstanding engaging walls 20 are provided for engaging the side of the furniture leg. The furniture leg is shown at 21 in FIG. 2 in dotted lines. As can be seen, the bottom of the furniture leg 21 is supported by ribs 22 provided on the upper surface 18 between the legs of the securing members 20 so that there is a space between leg 21 and upper surface 18. In addition, the spaces between the ribs 22, provides ventilation to the furniture leg to control and minimize dryrot. A pair of reinforcing ribs 24 provide additional strength to the upstanding wall members 20 to transmit lateral motion from the furniture leg 21 to the element 12 when it is to be slid across the ground.

As shown particularly in FIG. 2 the interior 26 of the bottom surface 16 is slightly concave to reduce part weight. Similarly, the upper surface 18 adjacent the rounded perimeter 14 is also slightly concave as indicated at 14A to facilitate molding of the product. The perimeter 14a also has upturned peripheral edges.

As seen in FIG. 2 the upper surface 18 is slightly convex to provide drainage so that any rain water hitting the element is drained towards the perimeter 14 and away from the bottom of the furniture leg which is supported at the center of the element 12.

As a result of the above described construction the element 19 provides a support which has a relatively smooth surface which distributes the load of the furniture over a large area and provides a smooth surface which can be readily slid across the surface of the ground. Thus, the furniture can be readily moved from place to place so as to reposition the furniture for whatever reason, such as mowing the lawn or to move it in or out of shade, as desired.

In a preferred embodiment of the invention the product is molded of a plastic material such as low density polyethylene, or polypropylene. In one preferred form the support is on the order of 7⅝ inches in diameter and has a thickness on the order of 5/32 inch. It can be attached to the bottom of the furniture leg by means of screws (not shown) which pass through the wall means 20. The spacing between the walls 20 is preferably about 1 9/16 inches and the walls 20 are slightly tapered outwardly to permit easy attachment to the bottom of the furniture leg.

Ribs 22 also reinforce the central portion 26 of the support 10. Molding sprues 20*a* also serve to reinforce the upstanding walls 20.

While one preferred embodiment of the invention has been described above, numerous modifications thereof can be made within the skill of the art without departing from the spirit of the invention.

I claim:

1. A support for engaging the bottom of a lawn furniture leg;

the support comprising a unitary molded element having upper and bottom surfaces each with an area at least five times greater than the area of the bottom of the leg;

upstanding wall means for engaging the sides of the leg and securing the support to the leg; and means for supporting the bottom of the legs so that the leg bottom is spaced above the top surface of the support a sufficient distance to permit drainage of water under the leg whereby to prevent dryrot to the leg.

2. A support for engaging the bottom of a lawn furniture leg;

the support comprising a unitary molded element having upper and bottom surfaces each with an area at least five times greater than the area of the bottom of the leg;

upstanding wall means for engaging the sides of the leg and securing the support to the leg;

the upper surface of the support being tapered downwardly from the center towards the edge; and means for supporting the bottom of the leg so that the leg bottom is spaced above the top surface of the support a sufficient distance to permit drainage of water under the leg whereby to prevent dryrot to the leg.

3. A support for engaging the bottom of a lawn furniture leg;

the support comprising a unitary molded element having upper and bottom surfaces each with an area at least five times greater than the area of the bottom of the leg;

upstanding wall means for engaging the sides of the leg and securing the support to the leg;

means for supporting the bottom of the legs so that the leg bottom is spaced above the top surface of the support a sufficient distance to permit drainage of water under the leg whereby to prevent dryrot to the the upper surface of the support being tapered downwardly from the center towards the edge.

4. The support of claim 3, wherein the edge is rounded to permit easy sliding across lawn.

5. The support of claim 3, wherein the element is circular.

6. The support of claim 3, wherein the central portion of the bottom surface of the support is slightly elevated.

7. The support of claim 3 wherein strengthening ribs are provided adjacent the outside surfaces of said wall means.

* * * * *

UNITED STATES PATENT AND TRADEMARK OFFICE

CERTIFICATE OF CORRECTION

PATENT NO. : 5,427,342

DATED : Jun. 27, 1995

INVENTOR(S) : Donald F. Gagnon

It is certified that error appears in the above-indentified patent and that said Letters Patent is hereby corrected as shown below:

Claim 3, Col. 3, line 12, after "the" insert --leg;--

Signed and Sealed this

Nineteenth Day of September, 1995

*Attest:*

*Attesting Officer*

BRUCE LEHMAN

*Commissioner of Patents and Trademarks*